US006945449B2

(12) United States Patent
Hengami

(10) Patent No.: US 6,945,449 B2
(45) Date of Patent: Sep. 20, 2005

(54) PACKAGE DESIGN AND METHOD OF FORMING A PACKAGE

(75) Inventor: David Todjar Hengami, 4455 Torrance Blvd., #356, Torrance, CA (US) 90503

(73) Assignee: David Todjar Hengami, Torrance, CA (US)

( * ) Notice: Subject to any disclaimer, the term of this patent is extended or adjusted under 35 U.S.C. 154(b) by 230 days.

(21) Appl. No.: 10/114,011

(22) Filed: Mar. 26, 2002

(65) Prior Publication Data

US 2002/0179699 A1 Dec. 5, 2002

Related U.S. Application Data

(63) Continuation-in-part of application No. 09/619,700, filed on Jul. 19, 2000, now Pat. No. 6,435,402, and a continuation-in-part of application No. 09/748,696, filed on Dec. 26, 2000, now Pat. No. 6,360,942.

(60) Provisional application No. 60/144,522, filed on Jul. 19, 1999.

(51) Int. Cl.[7] ..... B65D 5/42

(52) U.S. Cl. ..... 229/129.1; 229/120.18; 229/122; 229/131.1

(58) Field of Search ..... 229/117.27, 117.28, 229/117.3, 117.31, 117.35, 120.03, 120.18, 121, 122, 125.12, 129.1, 131.1, 164.2, 220, 242

(56) References Cited

U.S. PATENT DOCUMENTS

| | | | | | |
|---|---|---|---|---|---|
| 958,707 | A | | 5/1910 | Stafford | |
| 2,387,640 | A | | 10/1945 | Bouchelle | |
| 2,569,018 | A | | 9/1951 | Priester | |
| 2,903,175 | A | * | 9/1959 | Peimer | 229/220 |
| 2,983,421 | A | * | 5/1961 | Turpin | 229/121 |
| 2,983,424 | A | | 5/1961 | Glass | |
| 3,031,070 | A | | 4/1962 | Mulder | |
| 3,033,436 | A | * | 5/1962 | Peimer | 229/220 |
| 3,040,953 | A | | 6/1962 | Tindall | |
| 3,343,744 | A | | 9/1967 | Morell et al. | |
| 4,066,207 | A | | 1/1978 | Jorgensen-Beck et al. | |
| 4,081,128 | A | * | 3/1978 | O'Neill | 229/220 |
| 4,138,016 | A | | 2/1979 | Roccaforte | |
| 4,141,485 | A | | 2/1979 | Lambert | |
| 4,197,985 | A | * | 4/1980 | Austin | 229/220 |
| 4,269,347 | A | | 5/1981 | Cavan, Jr. | |
| 4,342,417 | A | | 8/1982 | Forbes, Jr. | |
| 4,361,270 | A | | 11/1982 | Roccaforte | |
| 4,413,769 | A | | 11/1983 | Michetti | |
| 4,609,142 | A | | 9/1986 | Adamek | |
| 5,056,708 | A | | 10/1991 | Boyle et al. | |
| 5,263,612 | A | | 11/1993 | Nederveld | |
| 5,348,219 | A | | 9/1994 | Brintazzoli | |
| 5,413,276 | A | | 5/1995 | Sheffer | |
| 5,429,243 | A | | 7/1995 | Woelk et al. | |
| 5,505,373 | A | | 4/1996 | von Stillfried | |
| 6,089,369 | A | | 7/2000 | Markey | |
| 6,360,942 | B2 | * | 3/2002 | Hengami | 229/129.1 |
| 6,435,402 | B1 | * | 8/2002 | Hengami | 229/120.03 |

OTHER PUBLICATIONS

International Search Report for International Application PCT/US00/35330 dated May 2, 2001.

* cited by examiner

*Primary Examiner*—Gary E. Elkins
(74) *Attorney, Agent, or Firm*—Fulwider Patton Lee & Utecht, LLP; Scott R. Hansen

(57) ABSTRACT

A box for conveniently storing and dispensing material has a front wall, a back wall, a first and a second side wall, a first one of the side walls having an opening and an inside surface, a top and a bottom flap, and a slide that is in contact with the inside surface of the first side wall, with the slide having an opening. The front wall, back wall, first and second side walls, and top and bottom flaps are interconnected so as to form a box, the slide being movable between an open position in which the slide opening substantially aligns with the side wall opening and a closed position in which the slide opening is entirely out of alignment with the front wall opening, thereby closing the box. As one option, the slide may have sides which are cut to extend generally parallel to the top flap when the box is in the form of a flat blank prior to box formation.

18 Claims, 7 Drawing Sheets

PACKAGE DESIGN AND METHOD OF FORMING A PACKAGE

I. RELATED APPLICATIONS

This patent application is a continuation-in-part of U.S. Pat. Ser. No. 09/619,700, which was filed on Jul. 19, 2000 now U.S. Pat. No. 6,435,402. As such, this patent application also claims the benefit of U.S. Provisional Patent Application No. 60/144,522, which was filed on Jul. 19, 1999. This patent application is also a continuation-in-part of U.S. patent application Ser. No. 09/748,696, filed on Dec. 26, 2000 and issued as U.S. Pat. No. 6,360,942. This patent application claims the benefit of a U.S. Provisional Patent Application 60/363,722 entitled "Package Design & Method For Forming a Package," which David Todjar Hengami filed on Mar. 11, 2002. This application also relates to U.S. Pat. Nos. 6,273,332 and 6,116,499, both of which are entitled "Package Design," and to U.S. Pat. No. 5,505,373, entitled "Folding Package." This patent application incorporates all of the foregoing patents and patent applications by reference in their entirety.

II. BACKGROUND OF THE INVENTION

A. Field of the Invention

The present invention relates to the field of packaging and, in particular, to packaging for pourable food and other items.

B. Prior Art

A wide range of pourable products, such as candies, cereals, laundry soaps, and many other products, are dispensed in cardboard boxes. To access the contents, a user must generally open the top of the box. Sometimes the contents are held in a wax paper bag inside the box, and the bag must be opened as well. To store the contents, the user closes the bag and then closes the box.

U.S. Pat. No. 5,505,373 discloses a novel box for conveniently storing and dispensing pourable items. The box has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out. The box also has a closed position for storing the contents.

III. SUMMARY OF THE INVENTION

Broadly defined, the present invention is an improved packaging system for products that can be poured. Most commonly, those products will be pourable products, such as cereals, candies, rice, detergents, and a multitude of other products. However, in a broad sense, the packaging system can be used with liquids and other pourable products.

In one embodiment, a box for conveniently storing and dispensing material has a front wall, a back wall, a first and a second side wall, a first one of the side walls having an opening and an inside surface, a top and a bottom flap, and a slide that is in contact with the inside surface of the first side wall, with the slide having an opening. The front wall, back wall, first and second side walls, and top and bottom flaps are interconnected so as to form a box, the slide being movable between an open position in which the slide opening substantially aligns with the side wall opening and a closed position in which the slide opening is entirely out of alignment with the front wall opening, thereby closing the box. As one option, the slide may have sides which are cut to extend generally parallel to the top flap when the box is in the form of a flat blank prior to box formation.

Embodiments of the invention may have particular features. For example, the box may have an opening on a second side of the box, and a second slide to open and close the second opening. Some embodiments of the invention may use slides that have no opening, such that the box is opened when then end of the slide clears the corresponding box opening as the user lifts the slide from a closed to an open position.

Various other features and aspects of the invention are apparent from the following Detailed Description, from the Claims and from the Drawings.

IV. BRIEF SUMMARY OF THE DRAWINGS

V. DETAILED DESCRIPTION OF THE PREFERRED EMBODIMENT

Figure 1:
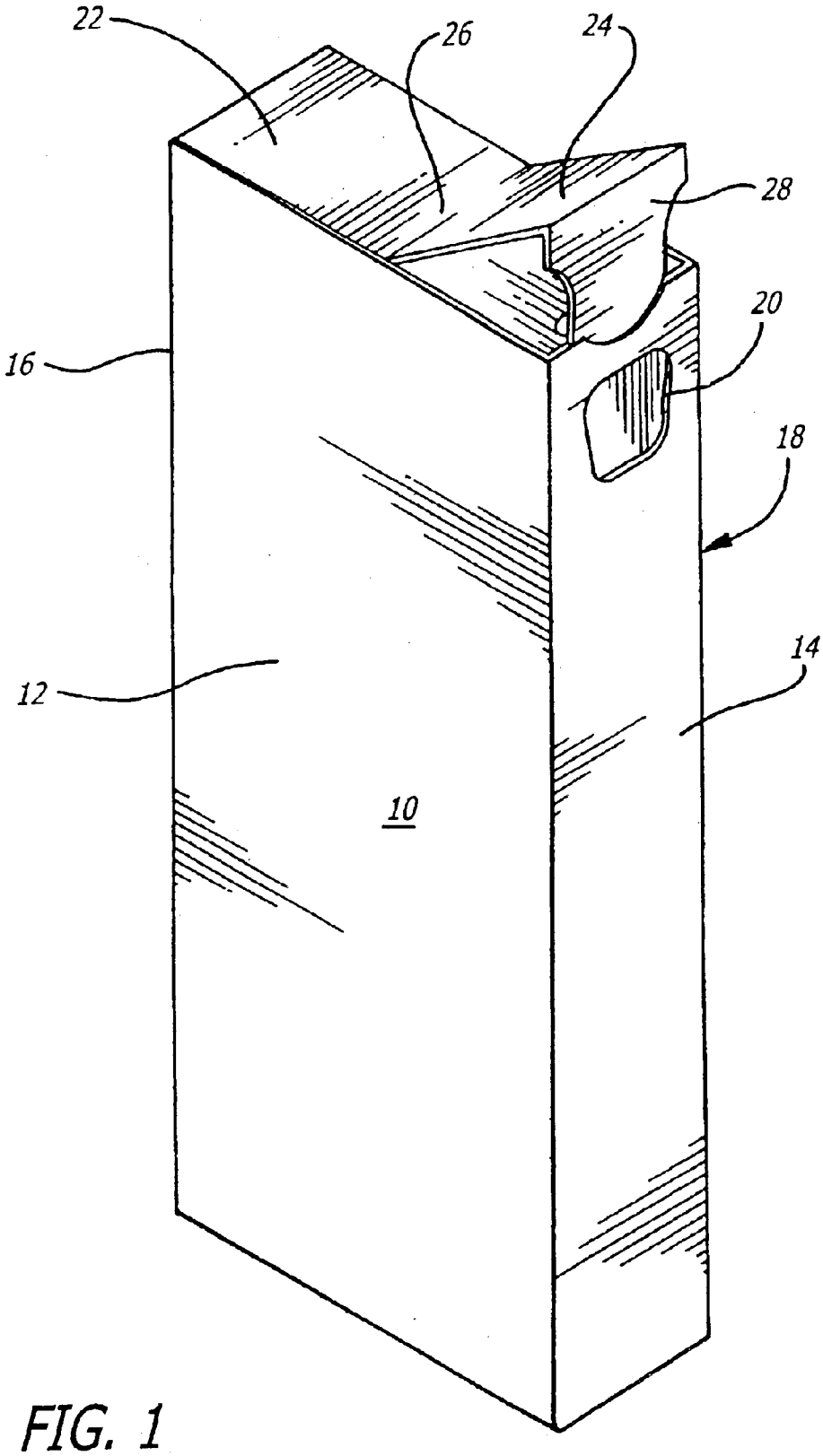
FIG. 1 illustrates a one embodiment of a box.

FIG. 1 illustrates one embodiment of a package 10 for pourable products. The package has a front wall 12, two side walls 14 and 16, a rear wall, a top and a bottom. At least one of the side walls has an opening 20 through which, when the package is in an open mode, the user may pour the pourable product.

The top of the package 22 includes a portion that is fixed in place, and a portion 24 that rotates up and down about a fold line 26. That portion is connected to a slide 28.

The package in FIG. 1 is in an open mode, in which the portion of the top of the package has been rotated upward such that the slide does not block the opening in the side wall. The contents may then be poured out of the package through the side wall. The user may close the side wall opening and put the package in a closed mode by rotating the portion of the top downward until the slide blocks the opening in the side wall. A top portion closes off the top of the box, even when the slide is in the lifted, open position of FIG. 1.

Figure 2:
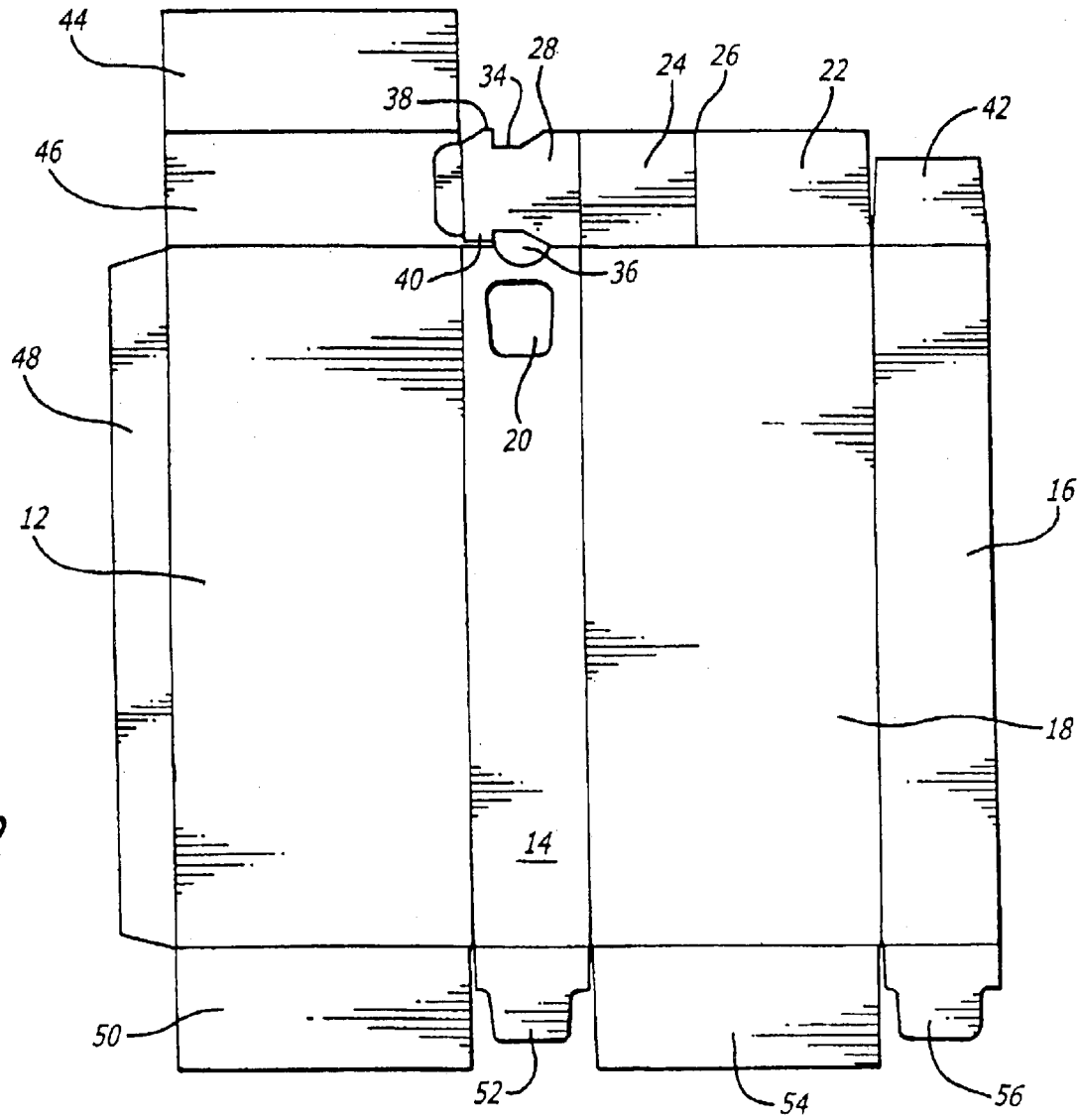
FIG. 2 illustrates a package blank from which the package of FIG. 1 may be formed.

FIG. 2 is a package blank that has been cut from a sheet of light cardboard or other packaging material known in the art. The package blank may be cut with die-cutting, for example, or may be cut with another cutting technique known in the art, such as laser cutting. The blank includes a number of fold lines, which may be score lines for example, so that the blank may be folded into a package.

The package blank of FIG. 2 has a front wall 12, side walls 14 and 16, a rear wall 18, top flaps 42, 44, 46 and the bottom flaps 50, 52, 54, 56, and a slide portion. The slide may include notches 34 and 36 and protrusions 38 and 40, with the protrusions serving to maintain the slide within the package when the package is assembled. Once the package blank is folded into the package of FIG. 1, the package may be held together with an adhesive or glue. Suitable adhesives and glues are known in the package making art.

Figure 3:
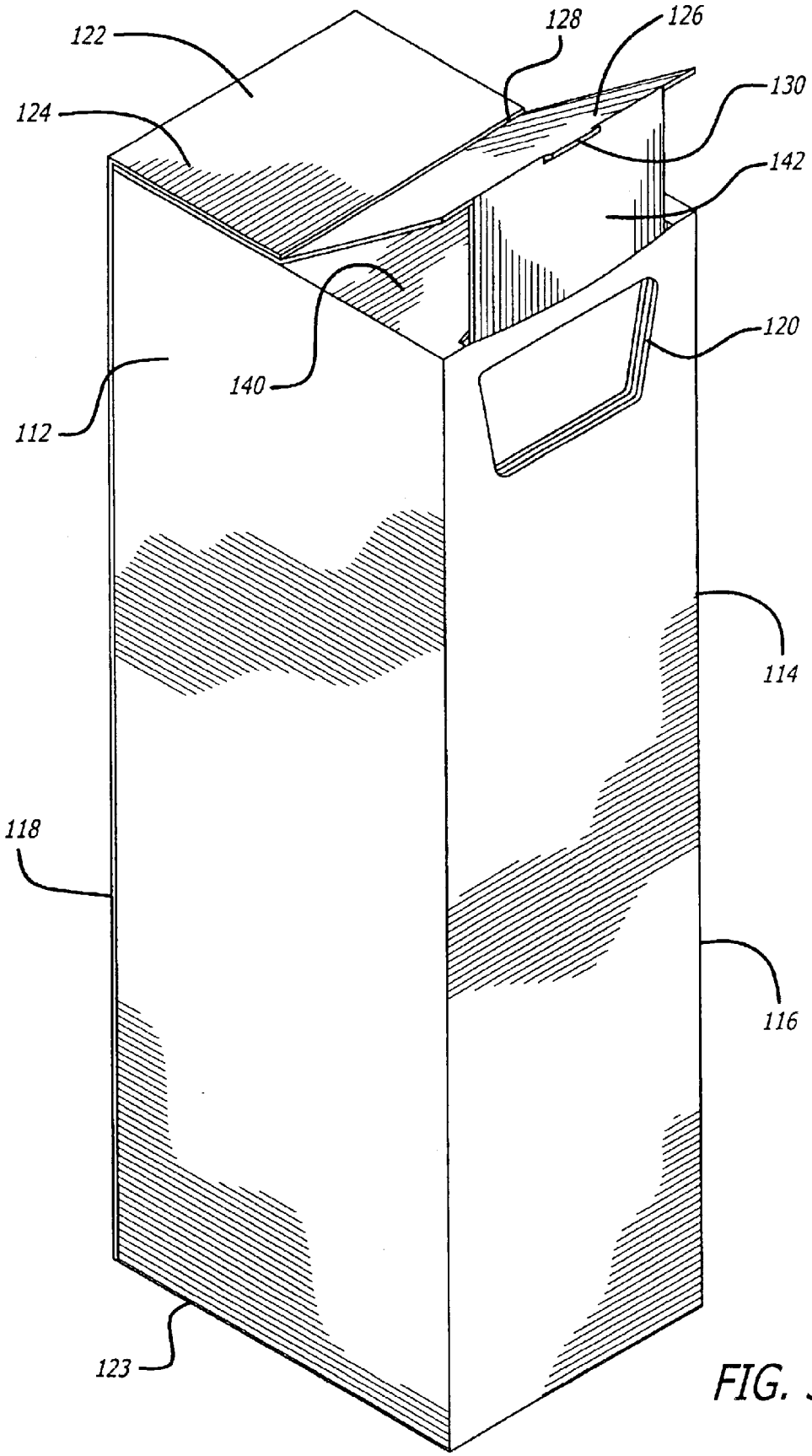
FIG. 3 illustrates another package embodiment having a dual-slide system, with slides at either end of the package.

FIG. 3 is another package for dispensing pourable material. Like the embodiment of FIG. 1, the package of FIG. 3 includes front 112 and rear 114 walls, side walls 116, 118, a top flap 122 and a bottom flap 123. A portion of 124 of the top flap is stationary, and another portion 126 rotates up and down about a fold line 128. The package may have a finger notch 130 that permits the user to engage a finger with the notch to move the slide up and down to open or close opening 120. A top portion 140 closes off the top of the box, even when the slide 142 is in the lifted, open position of FIG. 3.

Figure 4:
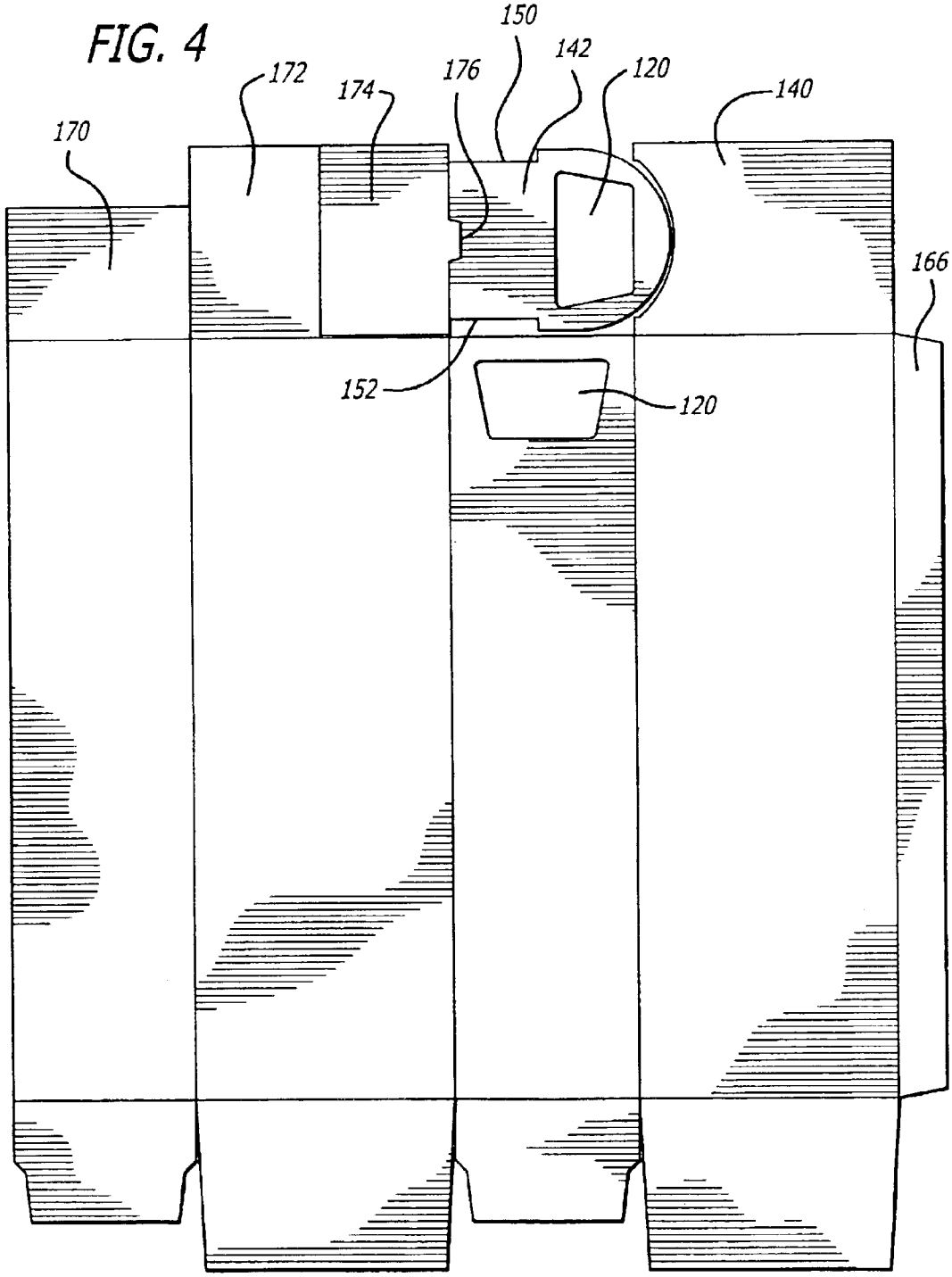
FIG. 4 illustrates a particularly material-efficient package blank for forming the package of FIG. 3.

FIG. 4 illustrates a package blank for forming the package of FIG. 3. The package blank of FIG. 4 has features similar to the package blank of FIG. 2. For example, the respective slides of FIG. 2 and FIG. 4 have sides 150, 152 which are cut to extend generally parallel to the respective top flaps when the box is in the form of the flat blank, prior to box formation. This configuration efficiently uses the package blank material, and results in little material waste when package blanks are cut from larger sheets of package material. In a high-volume manufacturing operation, this efficient use of material can result in substantial cost savings as compared to designs that are less material efficient. In a broad way, the slide or slider may be considered to include the movable members 142 and 174, as shown in FIG. 4, and the fixed slide base part 172. The top flap 170 as shown in FIG. 4 extends over the fixed base part 172 of the slide or slider up to the pivot line between parts 172 and 174. In addition, the top flap 140 underlies the base member 172 and the adjacent movable part 174 of the slide or slider. The tab 176 is also found to facilitate raising part 142.

Figure 5:
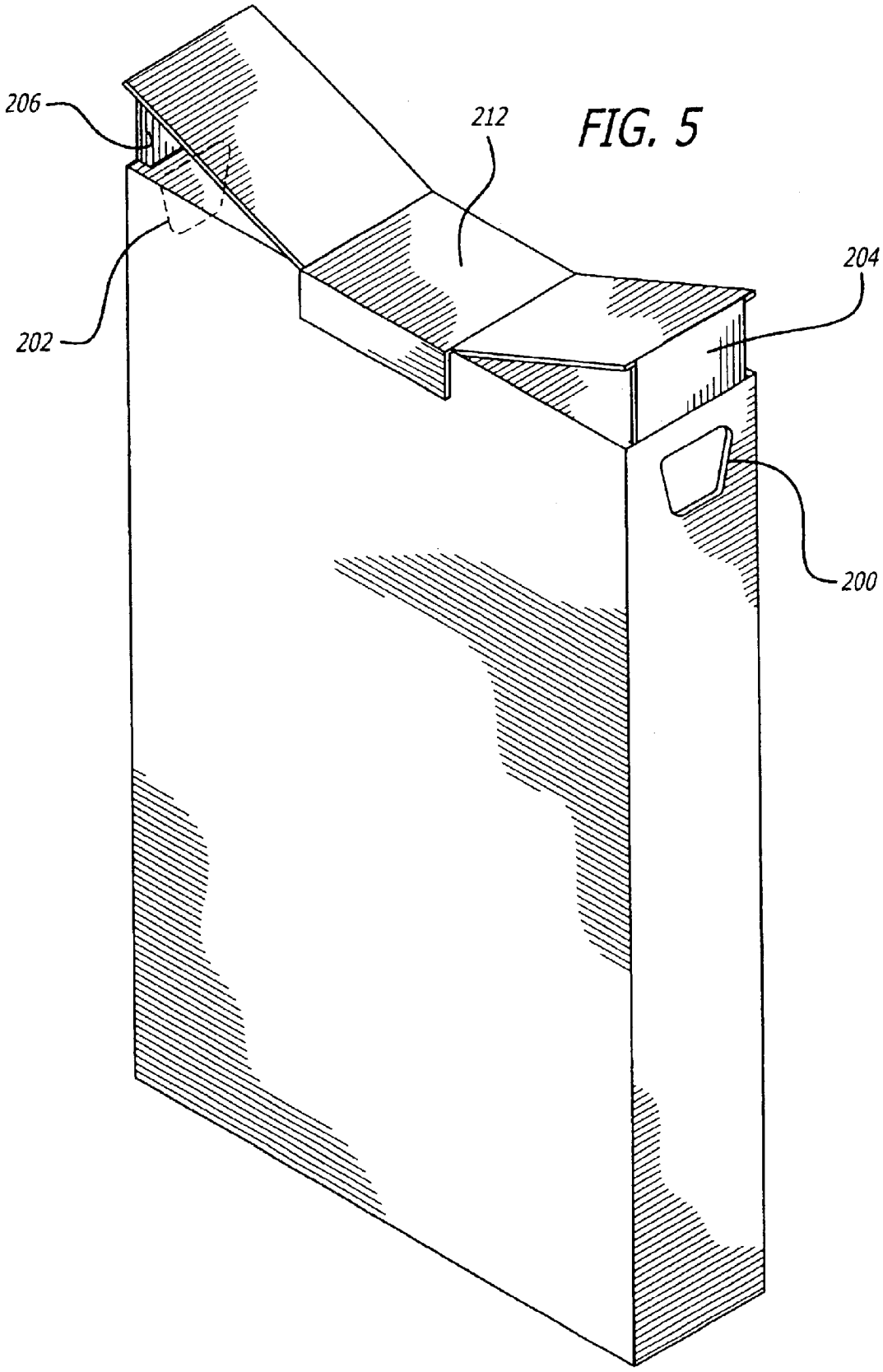
FIGS. 5 and 6 illustrate another embodiment of a package design and a blank for forming the package, respectively.

FIG. 5 illustrates an alternative embodiment in which a package has openings 200, 202 on each of the two opposite sides walls. The package also has two slides 204, 206, with each slide corresponding to a respective side wall opening. The interior of the package may have separate compartments, such that each side wall opening corresponds to a separate compartment. So, for example, one pourable product may be poured through one opening 200, while another pourable product may be poured through the other opening 202, when different pourable products are stored in the respective inner compartments.

Alternatively, the package of FIG. 5 need not have separate compartments, such that a common supply of pourable material may be poured through either or both of the side wall openings.

Figure 6:
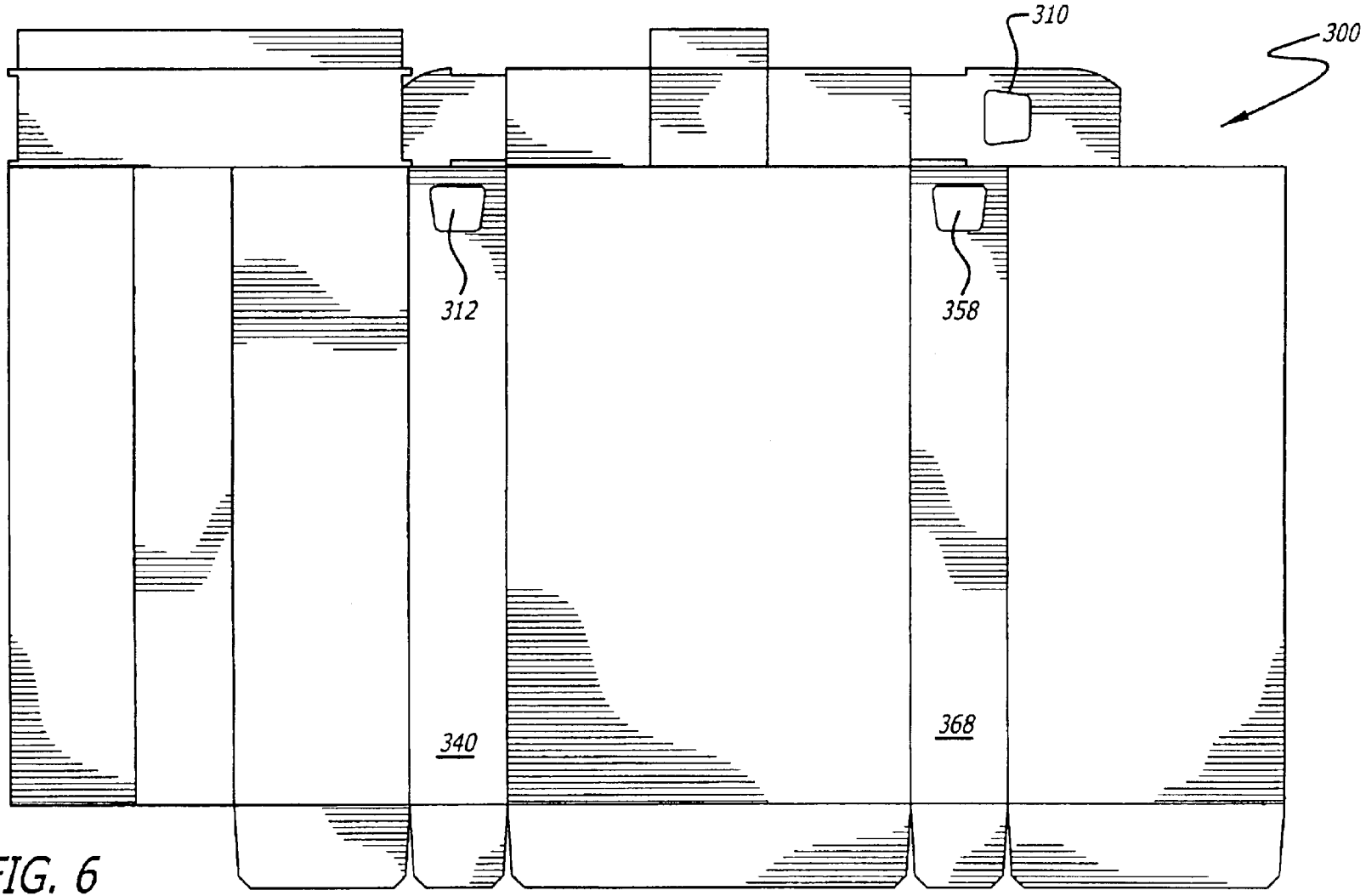

FIG. 6 illustrates a cut package blank for forming the package of FIG. 5. Note that, as in the embodiments of FIGS. 2 and 4, the package blank of FIG. 6 has slides or sliders 300 which are cut to extend generally parallel to the respective top flaps when the box is in the form of the flat blank, prior to box formation. It is noted that the respective slides may each have an opening that corresponds with the opening (312, 358) on the respective side wall (340, 368) or one slide may have an opening 310 and the other no opening, or both slides may have no opening. In the embodiment of FIG. 6, one slide has an opening 310, while the other has no opening.

Figure 7:
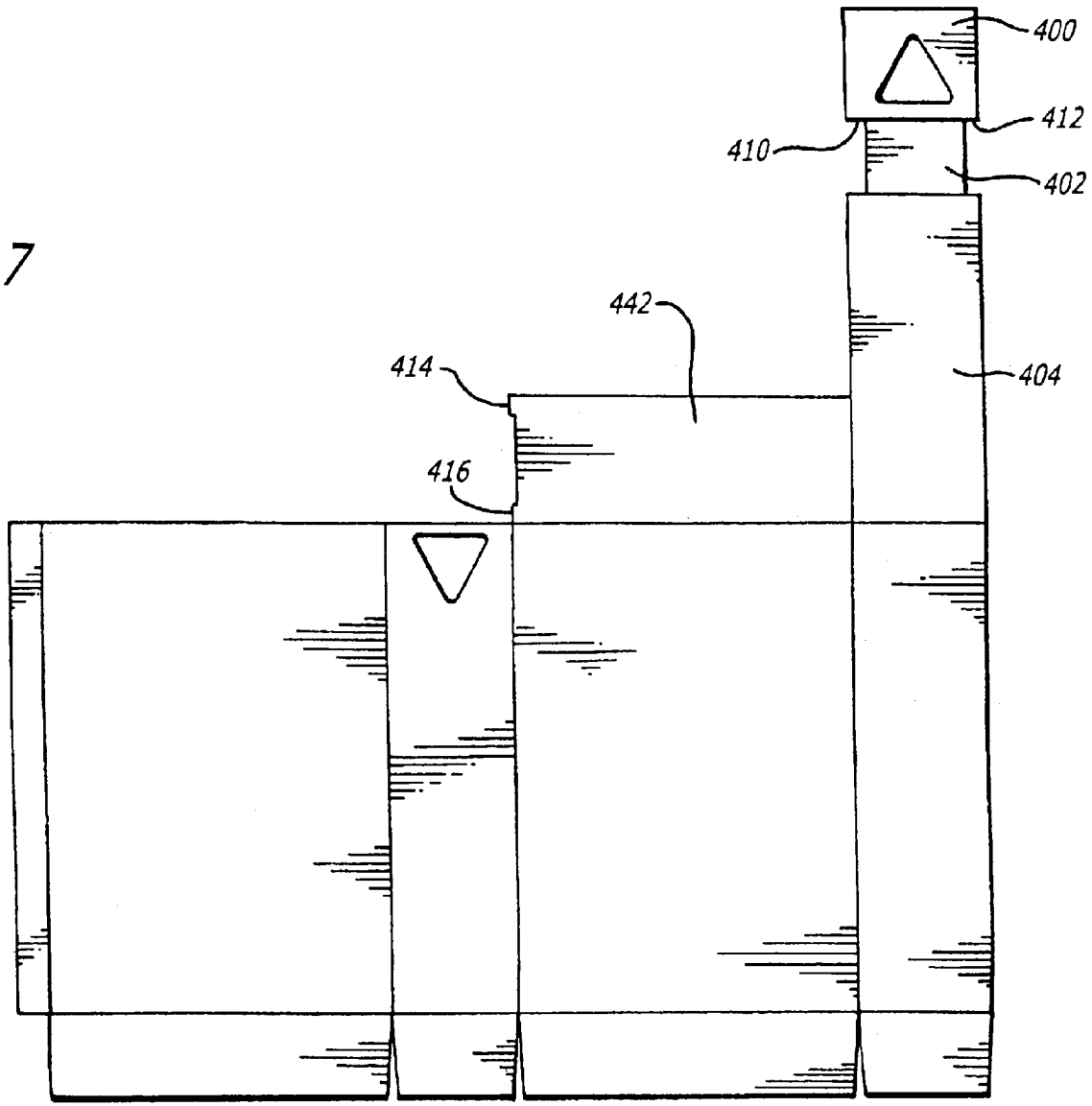
FIG. 7 is a blank for forming an embodiment in which the slide has a wider portion and a narrow portion.

FIG. 7 illustrates a further package embodiment, in which the slide is not cut parallel to the top flap. However, the slide is a three-part design, having an end portion 400, an intermediate portion 402, and an initial portion 404. The width of the intermediate portion 402 is less than the width of the end portion 400, so as to create stop portions on the end, to keep the slide within the package. In particular the stop portions 410, 412 engage with protrusions 414, 416 on the top flap 442 when the slide is fully raised, such that the slide does not pull out of the box.

The embodiments of the present invention may be formed from a wide variety of materials. The presently-preferred material is sulfate cellulose cardboard. However, the box may alternatively be made of plastic or wax. Other materials such as paper and wood may also be utilized to form part or all of the box in special embodiments.

In a further embodiment, the box opening and/or the slide opening may be sealed with a small sheet of plastic, wax paper, or other sealing material. The small sheet may be adhered about the edges of the opening with an adhesive, or otherwise attached to the box. The small sheet may be perforated or provided with lines of weakness to define a removable portion, which the user removes before dispensing the contents of the box. A tab or tear strip may be provided on the sealing sheet to assist in removing the removable portion. Alternatively, the sheet may be a sticker that the user peels away rather than tearing. This embodiment may be used without an inner liner with some pourable products, such as powdered dishwasher soap and rice, to name just a few.

In a further alternative embodiment, a bag is provided with a zipper or other known at sliding closure system. In this embodiment, the user slides the closure to an open position rather than tearing along a line of weakness. The bag can then be re-sealed by sliding the closure to a shut position.

It should be noted that the relative dimensions of the drawings are approximate. The drawings are intended to convey general concepts and are not precise engineering drawings. The particular dimensions of the various embodiments may be adjusted as necessary. For example, but not limitation, the openings may be made proportionately larger or smaller in particular embodiments of the box, as can the various other openings in the boxes and bags.

It is further noted that the terms "front," "rear," and "side" are all relative, and that in a particular embodiment the sides may be wider than the front and rear.

Accordingly, the present invention is not limited precisely to the arrangements as shown in the drawings and as described in detail hereinabove.

What is claimed is:

1. A box for conveniently storing and dispensing material comprising:

a front wall;

a back wall;

a first and a second side wall: said side walls being narrower than said front and back walls;

a first one of said side walls having an opening and an inside surface;

a top and a bottom flap;

a slide that is in contact with the inside surface of said first side wall, said slide having an opening;

wherein said front wall, said back wall, said first and second side walls, and said top and bottom flaps are interconnected so as to form a box, said slide being movable between an open position in which said slide opening substantially aligns with said side wall opening and a closed position in which said slide opening is entirely out of alignment with said front wall opening, thereby closing said box; and said slide having sides which are cut so that said slide extends generally parallel to said top flap when said box is in the form of a flat blank prior to box formation;

said box having fold lines between the side walls and the front and back walls, and said slide having side edges which are cut perpendicular to said fold lines when said box is in the form of a flat blank prior to box formation;

whereby efficient use of package material and minimum waste are achieved, and said box including the slide may be formed by folding without special insertion of the slide.

2. A box as defined in claim 1 wherein said slide has a pivot line extending across the top of said box, and wherein said box includes first and second top flaps with said first top flap underlying said slide, and with said second top flap overlying said slide and extending to said pivot line of said slide.

3. A box for conveniently storing and dispensing material comprising:

a front wall;

a back wall;

a first and a second side wall;

a first one of said side walls having an opening and an inside surface;

a top and a bottom flap;

a slide for selectively blocking the opening in the side wall;

the box being formed from a flat blank, the flat blank comprising means for forming a front wall, a back wall, a first and a second side wall, a first one of said side walls having an opening and an inside surface, a top flap and a bottom flap and a slide for selectively blocking the opening in the side wall;

wherein said front wall, said back wall, said first and second side walls, and said top and bottom flaps are interconnected so as to form a box, said slide being movable between a closed position in which said slide blocks the side wall opening, and an open position in which the slide does not block the side wall opening;

said box having fold lines between the side walls and the front and back walls, and said slide having side edges which are cut perpendicular to said fold lines when said box is in the form of a flat blank prior to box formation;

whereby the outward extent of said slide is minimized and waste material is also minimized when the box is in the form of a flat blank prior to box formation.

4. A box as defined in claim 3 wherein said slide has stops cut into the sides thereof for engagement with said flap.

5. A box as defined in claim 3 wherein said slide has a pivot line extending across the top of said box, and wherein said box includes first and second top flaps with said first top flap underlying said slide, and with said second top flap overlying said slide and extending to said pivot line of said slide.

6. A box for conveniently storing and dispensing pourable comprising:

a front wall having an opening and an inside surface;

a back wall;

a first and a second side wall;

a top and a bottom flap;

a slide that is in contact with the inside surface of the front wall, said slide having an opening;

said slide having an end portion that includes the opening, an intermediate portion, and an initial portion, the intermediate portion being narrower than both the end portion and the initial portion;

wherein said front wall, said back wall, said first and second side walls, and said top and bottom flaps are interconnected so as to form a box, said slide being movable between an open position in which said slide opening substantially aligns with said front wall opening and a closed position in which said slide opening is entirely out of alignment with said front wall opening, thereby closing said box; and said box having fold lines between the side walls and the front and back walls, and said slide having side edges which are cut perpendicular to said fold lines when said box is in the form of a flat blank prior to box formation.

7. A box as defined in claim 6 wherein said slide has a pivot line extending across the top of said box, and wherein said box includes first and second top flaps with said first top flap underlying said slide, and with said second top flap overlying said slide and extending to said pivot line of said slide.

8. A box for conveniently storing and dispensing material comprising:

a front wall;

a back wall;

a first and a second side wall;

a first one of said side walls having an opening and an inside surface;

a top and a bottom flap;

a slide that is in contact with the inside surface of said first side wall, said slide having an opening;

wherein said front wall, said back wall, said first and second side walls, and said top and bottom flaps are interconnected so as to form a box, said slide being movable between an open position in which said slide opening substantially aligns with said side wall opening and a closed position in which said slide opening is entirely out of alignment with said front wall opening, thereby closing said box;

said slide having sides which are cut to extend generally parallel to said top flap when said box is in the form of a flat blank prior to box formation; and said slide having stops cut into the sides thereof for engagement with said flap.

9. A box for conveniently storing and dispensing material comprising:

a front wall;

a back wall;

a first and a second side wall;

a first one of said side walls having an opening and an inside surface;

a top and a bottom flap;

a slide that is in contact with the inside surface of said first side wall, said slide having an opening;

wherein said front wall, said back wall, said first and second side walls, and said top and bottom flaps are interconnected so as to form a box, said slide being movable between an open position in which said slide opening substantially aligns with said side wall opening and a closed position in which said slide opening is entirely out of alignment with said front wall opening, thereby closing said box;

said slide having sides which are cut to extend generally parallel to said top flap when said box is in the form of a flat blank prior to box formation; and said second side being provided with an opening, said slide being a first slide, and the box has a second slide for opening and closing the opening of the second side.

10. A box as defined in claim 9 wherein the first slide includes an opening, and the second slide has no opening.

11. A box as defined in claim 9 wherein both slides have sides which are cut to extend generally parallel to said top flap when said box is in the form of a flat blank prior to box formation.

12. A box for conveniently storing and dispensing material comprising:

a front wall;

a back wall;

a first and a second side wall;

a first one of said side walls having an opening and an inside surface;

a top and a bottom flap; and a slide for selectively blocking the opening in the side wall;

the box being formed from a flat blank, the flat blank comprising means for forming a front wall, a back wall, a first and a second side wall, a first one of said side walls having an opening and an inside surface, a top flap and a bottom flap and a slide for selectively blocking the opening in the side wall;

wherein said front wall, said back wall, said first and second side walls, and said top and bottom flaps are interconnected so as to form a box, said slide being movable between a closed position in which said slide blocks the side wall opening, and an open position in which the slide does not block the side wall opening; and said second side wall being provided with an opening, said slide is a first slide, and the box has a second slide for opening and closing the opening of the second side.

13. A box as defined in claim 12 wherein the first slide includes an opening, and the second slide has no opening.

14. A box as defined in claim 12 wherein both slides have sides which are cut to extend generally parallel to said top flap when said box is in the form of a flat blank prior to box formation.

15. A box for storing and dispensing pourable comprising:

a front wall having an opening and an inside surface;

a back wall;

a first and a second side wall;

a top and a bottom flap;

a slide that is in contact with the inside surface of the front wall, said slide having an opening;

said slide having an end portion that includes the opening, an intermediate portion, and an initial portion, the intermediate portion being narrower than both the end portion and the initial portion;

wherein said front wall, said back wall, said first and second side walls, and said top and bottom flaps are interconnected so as to form a box, said slide being movable between an open position in which said slide opening substantially aligns with said front wall opening and a closed position in which said slide opening is entirely out of alignment with said front wall opening, thereby closing said box; and said slide having stops cut into the sides thereof for engagement with said flap.

16. A box for storing and dispensing pourable comprising:

a front wall having an opening and an inside surface;

a back wall;

a first and a second side wall;

a top and a bottom flap;

a slide that is in contact with the inside surface of the front wall, said slide having an opening;

said slide having an end portion that includes the opening, an intermediate portion, and an initial portion, the intermediate portion being narrower than both the end portion and the initial portion;

wherein said front wall, said back wall, said first and second side walls, and said top and bottom flaps are interconnected so as to form a box, said slide being movable between an open position in which said slide opening substantially aligns with said front wall opening and a closed position in which said slide opening is entirely out of alignment with said front wall opening, thereby closing said box; and said second side being provided with an opening, said slide being a first slide, and the box having a second slide for opening and closing the opening of the second side.

17. A box as defined in claim 16 wherein the first slide includes an opening, and the second slide has no opening.

18. A box as defined in claim 16 wherein both slides have sides which are cut to extend generally parallel to said top flap when said box is in the form of a flat blank prior to box formation.

* * * * *